United States Patent [19]

Cloutier

[11] Patent Number: 4,574,258

[45] Date of Patent: Mar. 4, 1986

[54] POLARIZED SIGNAL RECEIVING APPARATUS

[75] Inventor: Donald C. Cloutier, Exeter, N.H.

[73] Assignee: M/A-COM, Inc., Burlington, Mass.

[21] Appl. No.: 644,513

[22] Filed: Aug. 27, 1984

[51] Int. Cl.[4] ..... H01P 1/161; H01Q 3/02

[52] U.S. Cl. ..... 333/21 A; 333/254; 343/766

[58] Field of Search ..... 333/21 A, 254; 343/756, 343/759, 766

[56] References Cited

U.S. PATENT DOCUMENTS

| | | | |
|---|---|---|---|
| 2,548,821 | 4/1951 | Riblet et al. . | |
| 2,742,612 | 4/1956 | Cohn . | |
| 2,880,399 | 3/1959 | Murphy . | |
| 3,230,484 | 1/1966 | Lipetz et al. . | |
| 3,287,730 | 11/1966 | Kerr . | |
| 3,541,562 | 11/1970 | Dodington et al. | 343/766 X |
| 3,569,870 | 3/1971 | Foldes . | |
| 3,646,481 | 2/1972 | Den . | |
| 3,681,714 | 8/1972 | Terakawa . | |
| 3,857,112 | 12/1974 | Epis . | |
| 4,168,504 | 9/1979 | Davis . | |
| 4,414,516 | 11/1983 | Howard . | |
| 4,528,528 | 7/1985 | Augustin | 333/21 A |

*Primary Examiner*—Paul Gensler

*Attorney, Agent, or Firm*—Wolf, Greenfield & Sacks

[57] ABSTRACT

A polarized receiving apparatus in which there is provided a first waveguide for transmitting polarized signals and a second waveguide secured to the first for receiving polarized signals at one end thereof. An antenna means is provided having integrally formed portions including a receiver probe portion disposed in the second waveguide and extending generally axially of the second waveguide for receiving one polarization of the incident signal, a launch probe portion concentric with the axis of the first waveguide and extending generally axially of the first waveguide for launching said signal therein, and a drive portion intermediate the receiver and launch probe portions with said drive portion including a first gear. A drive source is supported in a housing member which defines the first waveguide and this drive source comprises at least a second gear adapted to mesh with the first gear for driving the antenna means.

15 Claims, 5 Drawing Figures

POLARIZED SIGNAL RECEIVING APPARATUS

BACKGROUND OF THE INVENTION

The present invention relates in general to an apparatus for receiving polarized microwave signals. More particularly, the present invention relates to a polarized signal receiving apparatus that is adapted to effectively divide energy from a signal microwave source into two linearly polarized waves disposed in time quadrature with respect to each other.

Prior art devices that appear in this general field include devices shown in the U.S. Pat. Nos. 2,548,821; 2,742,612; 2,880,399; 3,681,714; 4,168,504; 4,414,516. Existing devices generally operate somewhat ineffectively from a mechanical standpoint and do not have the desired accuracy of mechanical rotation. Many of these devices are also quite cumbersome, such as the device illustrated in U.S. Pat. No. 2,880,399.

Accordingly, it is an object of the present invention to provide an improved apparatus for receiving polarized signals. In accordance with the preferred embodiment of the present invention, the signal coupling occurs from a circular waveguide to a rectangular waveguide with both of these waveguides being arranged with coincident axes.

Another object of the present invention is to provide an improved polarizer which is characterized by minimal reflection over a relatively wide microwave frequency band.

Still another object of the present invention is to provide a polarizer having a signal conductor or antenna for detecting polarized incoming signals in a first waveguide and for launching the detected signals into a second waveguide. Herein, the first and second waveguides are preferably circular and rectangular, respectively.

A further object of the present invention is to provide a signal conductor or antenna as set forth in the preceding object, and which may be mechanically rotated with extreme accuracy to impart rotation to the plane of polarization of energy coupled from the circular waveguide.

SUMMARY OF THE INVENTION

To accomplish the foregoing and other objects, features and advantages of the invention, there is provided a polarized signal receiving apparatus which comprises a first waveguide for transmitting polarized signals and a second waveguide for receiving polarized signals at one end thereof. The first waveguide for transmitting polarized signals is preferably a rectangular waveguide and the second waveguide for receiving polarized signals is preferably a circular waveguide. Means are provided for securing the first and second waveguides together. The first waveguide is in the form of a housing that is also adapted to support a drive source to be referred to hereinafter. An antenna means is included having integrally formed portions, including a receiver probe portion disposed in the second waveguide and extending generally axially of the second waveguide for receiving one polarization of the incident signal. The antenna means also includes a lauch probe portion concentric with the axis of the first waveguide and extending generally axially of the first waveguide for launching the signal therein. Finally, the integral antenna means also includes a drive portion intermediate the receiver probe portion and the launch probe portion.

This drive portion of the antenna means includes a first gear. There is provided, as mentioned previously, a drive source supported in the housing member. This drive source comprises at least a second gear adapted to mesh with the first gear for driving the antenna means. The mechanical arrangement is extremely compact with the housing member being provided in a manner to enable mounting of the drive source essentially within the apparatus without requiring external drive members and without requiring the use of a large cumbersome housing structure.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
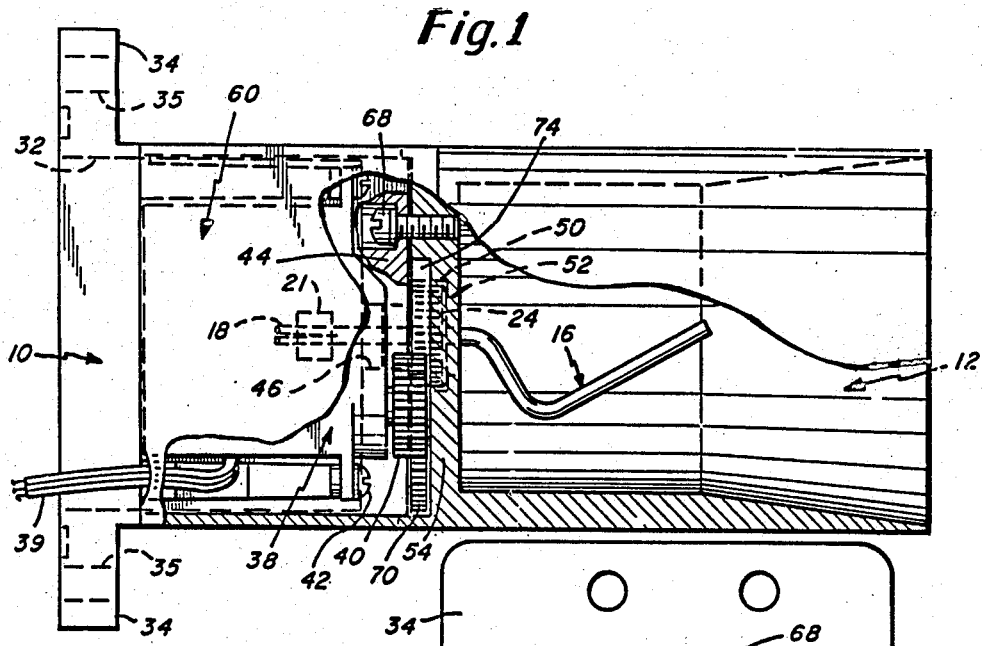
FIG. 1 is a plan view of a preferred embodiment of the apparatus of the present invention with part of the structure cut away to expose the internal parts.

Reference may now be made to the drawings of this invention which include FIGS. 1-5. The drawing illustrates a preferred embodiment of the polarized signal receiving apparatus of the present invention. This apparatus provides for a very compact rotating signal receiver in which all of the mechanical drive is provided in the apparatus itself, yet without making the apparatus unduly large. Also, the mechanical drive illustrated is a positive drive that provides for high resolution control of the antenna used with the apparatus.

Figure 4:
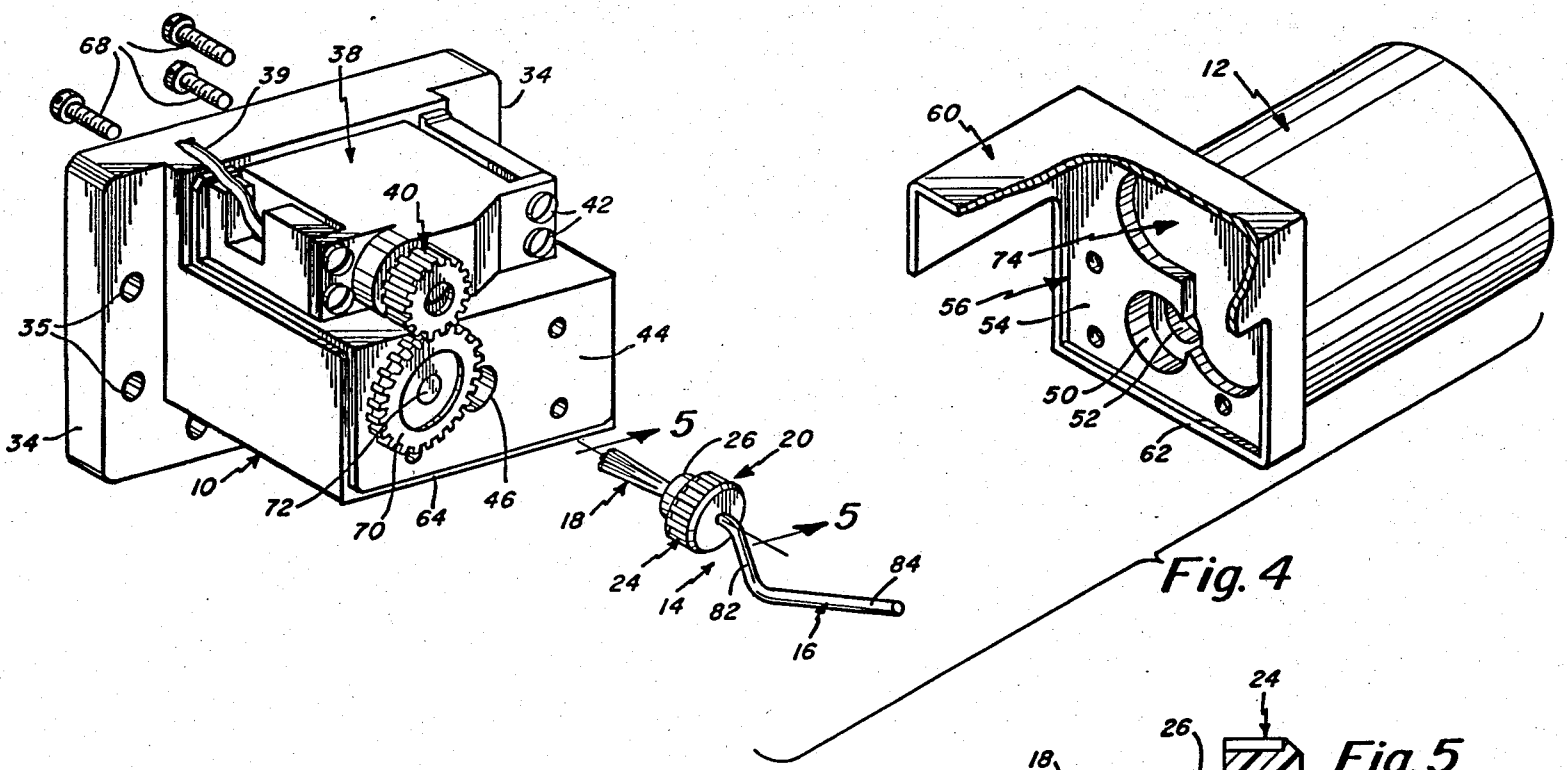
FIG. 4 is a perspective view with some of the parts shown in exploded perspective and illustrating the apparatus shown in FIGS. 1-3.

With reference to the drawings, there is shown a first waveguide for transmitting polarized signals. This is the waveguide 10 illustrated in the drawing and is a rectangular waveguide. There is also provided a second waveguide for receiving polarized signals at one end thereof. This is illustrated in the drawing as the waveguide 12, which is a circular waveguide. Along with the first waveguide and second waveguide is an antenna means 14 such as illustrated in FIG. 4. This antenna means has integrally formed multiple portions, including a receiver probe portion 16, a launch probe portion 18, and a drive portion 20 which is disposed intermediate the receiver probe portion 16 and the launch probe portion 18. As illustrated in FIG. 4, the drive portion of the antenna means comprises a gear 24 and associated hub 26.

The rectangular waveguide 10 comprises a housing member 30 including walls that define the rectangular waveguide opening 32. The housing member 30 has at its output coupling end, a peripheral flange 34 about three sides thereof such as illustrated in FIG. 4. The flange 34 is useful in securing the housing member to other waveguide sections not shown herein. For this purpose, there are a plurality of holes 35 through the flange.

The housing member 30 also includes a drive source in the form of a drive motor 38 having an output shaft which mounts a relatively small gear 40. The motor assembly is secured to the housing member by means of a series of securing screws 42.

Figure 3:
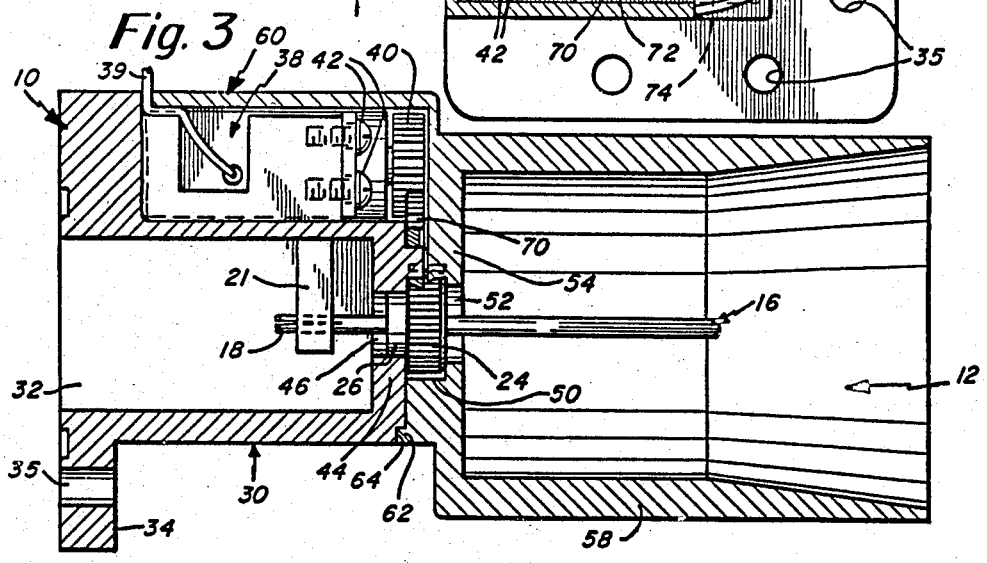
FIG. 3 is a cross-sectional view through the apparatus as taken along line 3—3 of FIG. 2.

The housing member 30 also includes an end wall 44 illustrated in FIGS. 3 and 4. The wall 44 has a circular passage 46 therethrough. It is the hub 26 associated with gear 24 that fits within the passage 46. In this regard, FIG. 3 illustrates the fitting of the antenna means 14 with the hub 26 positioned in the passage 46. The antenna means 14, and in particular the gear 24 thereof, is also held in position by means of a shoulder 50 illustrated in FIG. 4; the shoulder being defined at least in part by the passage 52 in the end wall 54 of the waveguide 12.

As indicated previously, the waveguide 12 is a circular waveguide and is defined by a housing means 56 which includes, in addition to the end wall 54, the circular wall 58 and extension 60. The extension 60 is dimensioned so as to cover the motor assembly 38. The extension 60 is also formed with a three-sided edge 62 that is adapted to mate with the three-sided corner 64 as illustrated in FIG. 4.

In order to secure the housing members 30 and 56 together, and thus secure the waveguides together, there are provided a plurality of bolts 68. One of these bolts 68 is illustrated in FIG. 1. These bolts may each pass through a hole in the end wall 44 of member 30 and be threaded into threaded holes in the end wall 54 of the member 56.

Figure 2:
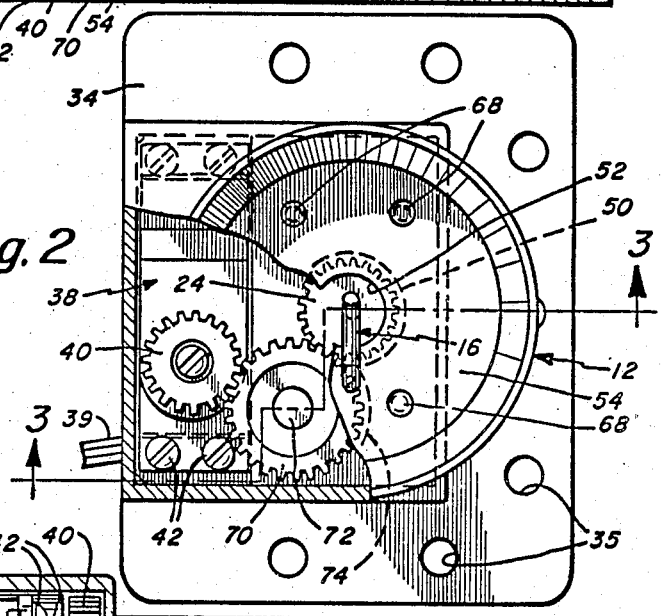
FIG. 2 is an end view also partially cut away to dispose further details of the apparatus.

Between the gears 24 and 40, there is provided a larger gear 70. The gear 70 is supported on a short shaft 72 which is supported on a hole in the end wall 44. The gear 70 is supported so that it properly meshes, as illustrated in FIG. 2 with both gears 24 and 40.

It is also noted in connection with the support for all gears that the housing member 56 is provided with an internal recess 74 that is shaped, as illustrated in FIG. 4, so as to accommodate each of the gears. When the two housing members 30 and 56 are secured together, the gears 24, 40, and 70 are all held in place and are free to rotate.

The motor assembly 38 may be controlled in a conventional manner and in this regard, there are shown leads 39 which couple to the motor assembly 38. The output of the motor drives the gear 40 which in turn engages with and drives the gear 70. The gear 70 in turn engages and drives the antenna means by virtue of driving the gear 24 which forms an integral part thereof. This direct drive at the antenna means provides for precise high resolution control of rotation of the antenna means and precisely controls the positioning in particular of the receiver probe portion of the antenna means.

Figure 5:
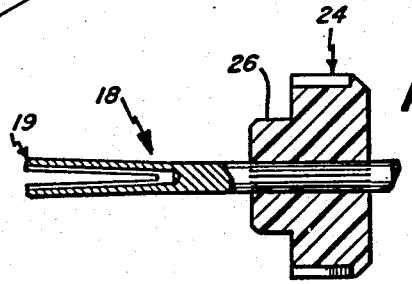
FIG. 5 is a cross-sectional view taken along line 5—5 of FIG. 4 showing further details of the antenna means of this invention.

With regard to the launch probe portion 18 of the antenna means, it is noted that this portion is forked as indicated at 19 in FIG. 5. To support this forked end there is provided an insulating member 21 supported from a wall of the waveguide 10. The insulating member 21 has a passage for receiving the forked end 19 of the launch probe portion 18.

Thus, it can be seen that in accordance with the present invention there is provided a very compact polarized signal receiving apparatus, particular adapted for signal reception in which there is provided a circular waveguide and a rectangular waveguide that are disposed with their axes coincident, such as clearly illustrated in FIGS. 1 and 3 of the present application. In FIGS. 1 and 3 it is noted that the receiver probe portion 16 lies substantially axially of the circular waveguide while the launch probe 18 lies on the mid-axis of the rectangular waveguide portion of the apparatus. It is also noted that the drive is substantially all internal and is controlled by a substantially internally supported motor. There is no requirement for any external mechanisms. Furthermore, the drive to the antenna means is at the most advantageous portion thereof which is preferably at the middle of the antenna means. In this way, the drive portion of the antenna means which is illustrated by the gear 24 provides for not only support of the antenna means, but also provides for an immediate way by which the antenna means is rotated. Also, by rotation of the antenna means at or near its mid-point, there is more stability provided with their being less likelihood of the receiver probe portion 16 becoming askew or out of coaxial relationship relative to the circular waveguide 12.

As indicated in FIG. 4, the antenna includes a double-reverse bend portion 82 followed by a substantially straight portion 84 which is inclined at an angle to the axis of the waveguide 12. It is also noted that with the use of the gear 24 and associated hub 26, there is essentially provided an interrelationship in which the receiver probe portion is of smaller diameter than the drive portion of the antenna means. In this way the shunt capacity effect of the drive portion step improves the impedance match of the device.

Having described one embodiment of the present invention, it should now be apparent to those skilled in the art that numerous other embodiments are contemplated as falling within the scope of this invention.

What is claimed is:

1. A polarized signal receiving apparatus comprising;
a first waveguide for transmitting polarized signals,
a second waveguide for receiving polarized signals at one end thereof,
means for securing the first waveguide to the second waveguide,
an antenna means having integrally formed portions including a receiver probe portion disposed in the second waveguide and extending generally axially of the second waveguide, for receiving one polarization of the incident signal, a launch probe portion concentric with the axis of the first waveguide and extending generally axially of the first waveguide for launching said signal therein, and a drive portion intermediate the receiver and launch probe portions, said drive portion including a first gear,
and a drive source supported in a housing member which defines the first waveguide and comprising at least a second gear adapted to mesh with the first gear for driving the antenna means.

2. A polarized signal receiving apparatus as set forth in claim 1 wherein said first waveguide is a rectangular waveguide.

3. A polarized signal receiving apparatus as set forth in claim 2 wherein said second waveguide is a circular waveguide.

4. A polarized signal receiving apparatus as set forth in claim 1 wherein said second waveguide is a circular waveguide.

5. A polarized signal receiving apparatus as set forth in claim 1 wherein said means for securing the first waveguide to the second waveguide comprises a plurality of screws.

6. A polarized signal receiving apparatus as set forth in claim 1 wherein said receiver probe portion includes a reverse bend segment followed by a substantially straight segment.

7. A polarized signal receiving apparatus as set forth in claim 6 wherein said launch probe portion is substantially straight.

8. A polarized signal receiving apparatus as set forth in claim 7 wherein said launch probe portion has a forked end.

9. A polarized signal receiving apparatus as set forth in claim 1 wherein said first waveguide is defined by a housing member, said first waveguide being rectangular and said housing member having means for supporting said drive source over said rectangular waveguide, said second gear being supported on a shaft that extends substantially parallel to the rectangular waveguide access but outside of the rectangular waveguide.

10. A polarized signal receiving apparatus as set forth in claim 9 further including a third gear disposed for engagement and between said first and second gears.

11. A polarized signal receiving apparatus as set forth in claim 10 wherein said third gear is supported from an end wall of said housing member defining the first waveguide.

12. A polarized signal receiving apparatus as set forth in claim 11 wherein said second waveguide is defined by a housing member having recess means for receiving said first, second and third gears.

13. A polarized signal receiving apparatus as set forth in claim 12 wherein said first gear has associated therewith a hub adapted to be received in a passage in the end wall of said first waveguide housing member.

14. A polarized signal receiving apparatus as set forth in claim 1 wherein said drive means also comprises a third gear disposed for engagement and between said first and second gears, all of said gears being disposed in the same vertical plane.

15. A polarized signal receiving apparatus comprising;

a first waveguide for transmitting polarized signals, a second waveguide for receiving polarized signals at one end thereof, means for securing the first waveguide to the second waveguide, an antenna means having integrally formed portions including a receiver probe portion disposed in the second waveguide and extending generally axially of the second waveguide, for receiving one polarization of the incident signal, a launch probe portion concentric with the axis of the first waveguide and extending generally axially of the first waveguide for launching said signal therein, and a drive portion intermediate the receiver and launch probe portions, said drive portion including a first drive means, and a drive source supported in a housing member which defines the first waveguide and comprising at least a second drive means adapted to mesh with the first drive means for driving the antenna means.

* * * * *